US005123394A

United States Patent [19]

Ogren

[11] Patent Number: 5,123,394

[45] Date of Patent: Jun. 23, 1992

[54] ROTARY RECIPROCATING INTERNAL COMBUSTION ENGINE

[76] Inventor: Warren Ogren, Rte. 8, Ogren Rd., Hayward, Wis. 54843

[21] Appl. No.: 527,335

[22] Filed: May 23, 1990

[51] Int. Cl.[5] ..... F02B 57/00

[52] U.S. Cl. ..... 123/44 D

[58] Field of Search ..... 123/43 R, 44 R, 44 D

[56] References Cited

U.S. PATENT DOCUMENTS

| | | | |
|---|---|---|---|
| 984,358 | 2/1911 | Dawson | 123/43 R |
| 1,042,675 | 10/1912 | Helmes | 123/44 D |
| 2,990,820 | 7/1961 | Saijo | 123/44 D |
| 3,292,603 | 12/1966 | Wayto | 123/44 D |
| 3,499,424 | 3/1970 | Rich | 123/44 D |
| 4,741,300 | 5/1988 | Benson | 123/44 D |

FOREIGN PATENT DOCUMENTS

| | | | |
|---|---|---|---|
| 329203 | 11/1920 | Fed. Rep. of Germany | 123/44 D |
| 376317 | 5/1964 | Switzerland | 123/43 R |
| 601657 | 12/1977 | Switzerland | 123/44 D |
| 1734 | 1/1915 | United Kingdom | 123/44 D |

*Primary Examiner*—Michael Koczo
*Attorney, Agent, or Firm*—Palmatier & Sjoquist

[57] ABSTRACT

A rotary reciprocating internal combustion engine is disclosed and includes a rotor with a set of four pistons driving respective spaced apart cranks. Each of the ends of the rotating cranks extends through a bearing in support plates on the rotor and includes a crank gear meshing with the teeth of a larger ring gear. The larger ring gear is fixed on the housing of the engine and is axially aligned with the rotor. The crank gears drive the rotor which in turn is fixed to and drives a power take off shaft. As the rotor is driven in the housing, fuel is supplied to the cylinders and combustion gasses are exhausted through openings formed in the housing. A pair of fuel intake ports, exhaust ports and spark plugs are provided for the four cylinders and pistons such that eight piston strokes are provided for each revolution of the power take off shaft.

1 Claim, 4 Drawing Sheets

ROTARY RECIPROCATING INTERNAL COMBUSTION ENGINE

The present invention relates to internal combustion engines, and more particularly, to rotary reciprocating internal combustion engines.

BACKGROUND OF THE INVENTION

A conventional internal combustion engine includes valves, valve springs, filters, a drive train, cam shafts, roller bearings and a plethora of corresponding moving parts.

SUMMARY OF THE INVENTION

A feature of the present invention is the feature in a rotary reciprocating internal combustion engine with a piston reciprocating in a cylinder formed in a rotor within a cylindrical stationary head, of a pair of crank gears driven by the piston and meshing with and riding in a pair of ring gears fixed to and axially aligned with the head to drive the rotor in a rotary motion in the head.

Another feature is the provision in such a rotary reciprocating engine, of a pair of cylinders and pistons in the rotor with the pistons reciprocating diametrically opposite of each other and with each of the pistons driving a crank gear.

Another feature is the provision in such a rotary reciprocating engine, of four cylinders and pistons in the rotor with each of the pistons driving a pair of crank gears and with each of the pistons being diametrically opposite one of the other pistons.

Another feature is the provision in such a rotary reciprocating engine, of a crank support plate affixed to each end of the rotor and a power take off shaft, and including crank bearings for the ends of each of the cranks to which the crank gears are affixed.

Another feature is the provision in such a rotary reciprocating engine, of an oil feed line extending axially in the power take off shaft and having an outlet in the rotor to provide oil to the cylinders and pistons.

An advantage of the present invention is that it has relatively few moving parts when compared to a conventional internal combustion engine.

Another advantage is that a smooth transfer of power is provided from the pistons to the power take off shaft. Conventionally, pistons drive connecting rods connected directly to a crank shaft. Such pistons typically can not be disposed in a common plane. With the present invention, the pistons drive connecting rods spaced from the power take off shaft and hence the cylinders, pistons and connecting rods and cranks may be disposed in a common plane for smooth rotary motion.

Another advantage is that only four cylinders are required for eight power strokes for each revolution of the power take off shaft. With a conventional piston arrangements each of the cylinders fire once for every revolution of the crankshaft. With the present rotor, each of the pistons fires twice for each revolution of the rotor to provide eight power strokes for every revolution of the power take off shaft.

DESCRIPTION OF THE PREFERRED EMBODIMENT

Figure 1:
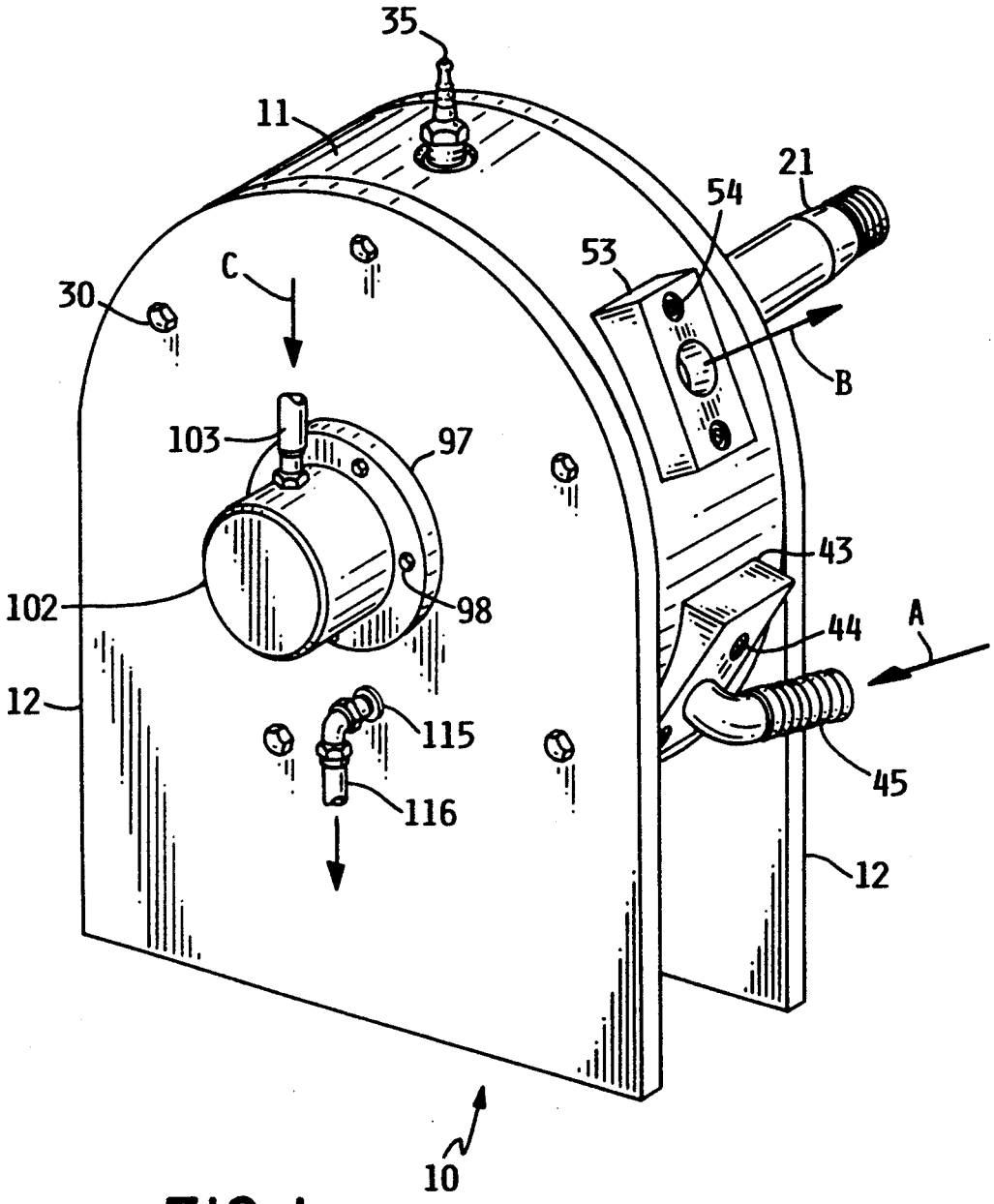
FIG. 1 is a perspective view of the present rotary reciprocating internal combustion engine.
Figure 2:
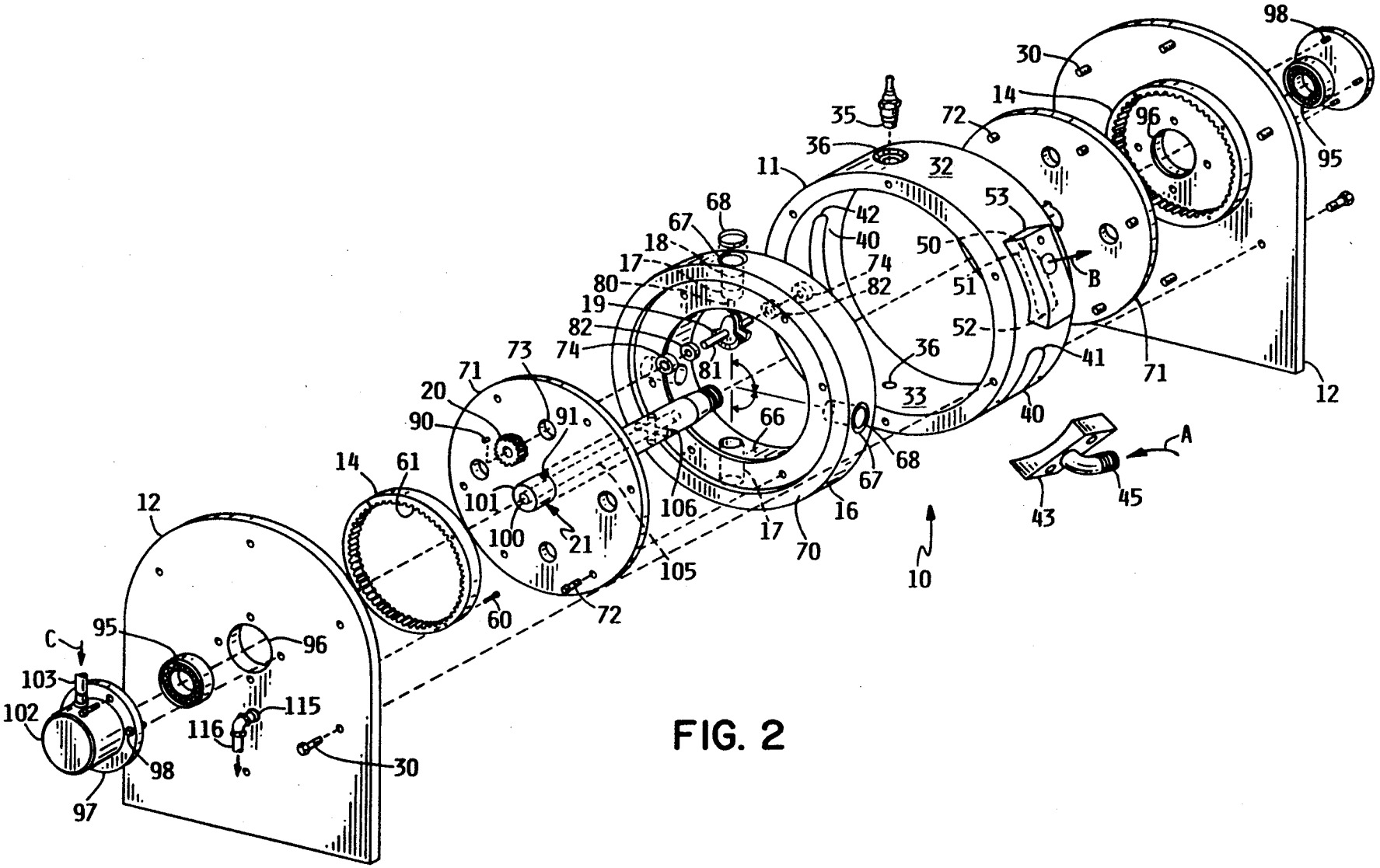
FIG. 2 is an exploded, partially phantom view of the rotary engine of FIG. 1.

As shown in FIG. 1, the present rotary reciprocating internal combustion engine is indicated in general by the reference numeral 10. The rotary engine 10 includes as its principal components a cylindrical head 11 with frame plates 12, ring gears 14 affixed to the plates 12, a rotor 16 in the head 11, cylinders 17 and pistons 18 in the rotor 16, and drive cranks 19 which drive crank gears 20. The crank gears 20 mesh with the ring gears 14 to drive the rotor 16 and a power take off shaft 21 axially affixed to the rotor 16. Each of the pistons 18 fires twice for each revolution of the power take off shaft 21.

The head 11 is fixed to and between the frame plates 12 with pin connectors 30. The frame plates 12 support the head 11 relative the surface so that the outer cylindrical surface 32 of the head 11 is accessible for the connection of manifolds or other engine components. An inner smooth cylindrical surface 33 runs parallel to the outer cylindrical surface 32 of the head 11.

The head 11 further includes a pair of ignition means or spark plugs 35 mounted in spark plug seats 36. The spark plugs 35 are disposed diametrically opposite of each other. The spark plugs 35 are fired simultaneously and each of the spark plugs 35 fires four times for each revolution of the power take off shaft 21.

Figure 3:
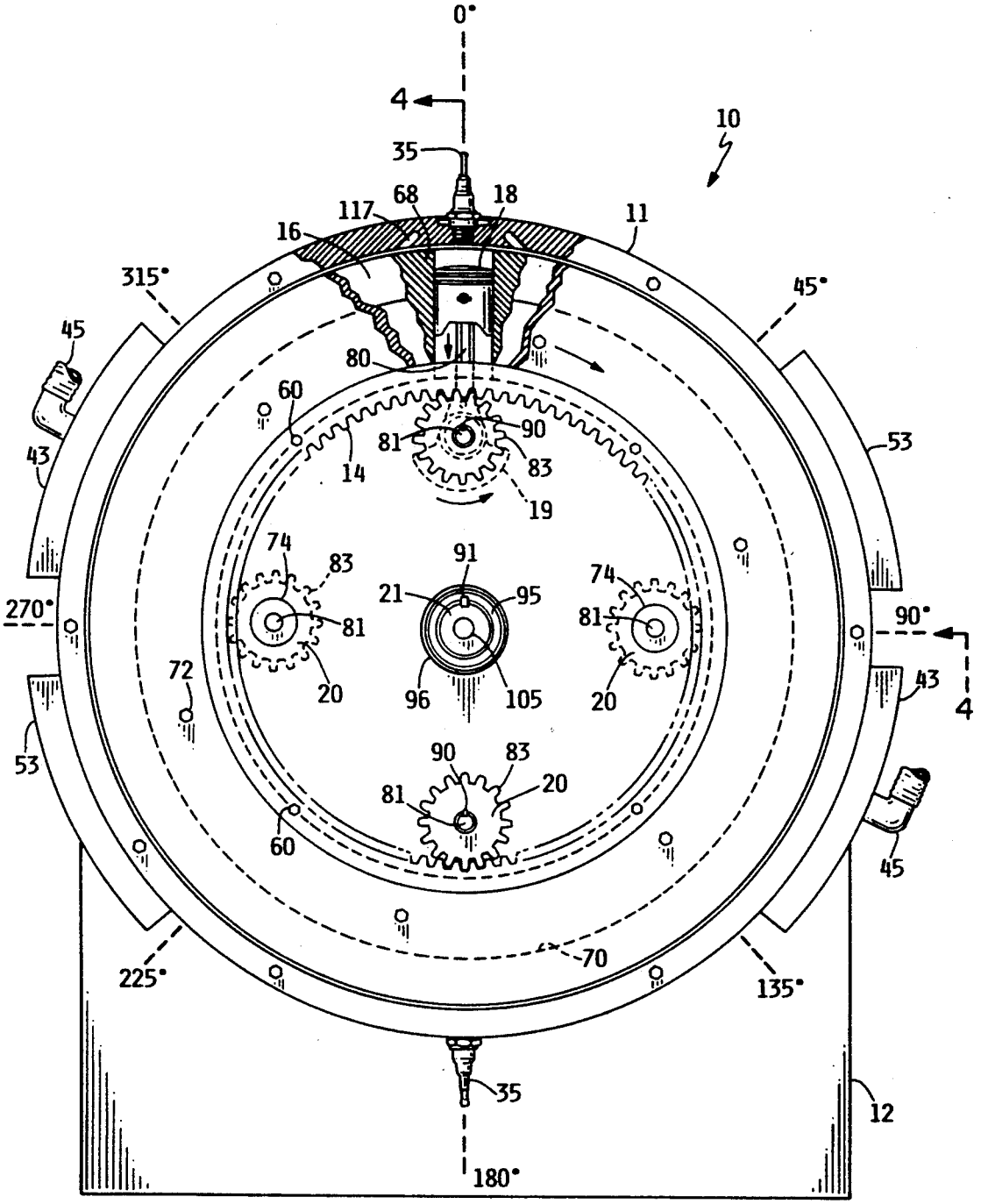
FIG. 3 is an elevation, partially section and phantom view of the rotary engine of FIG. 1.
Figure 4:
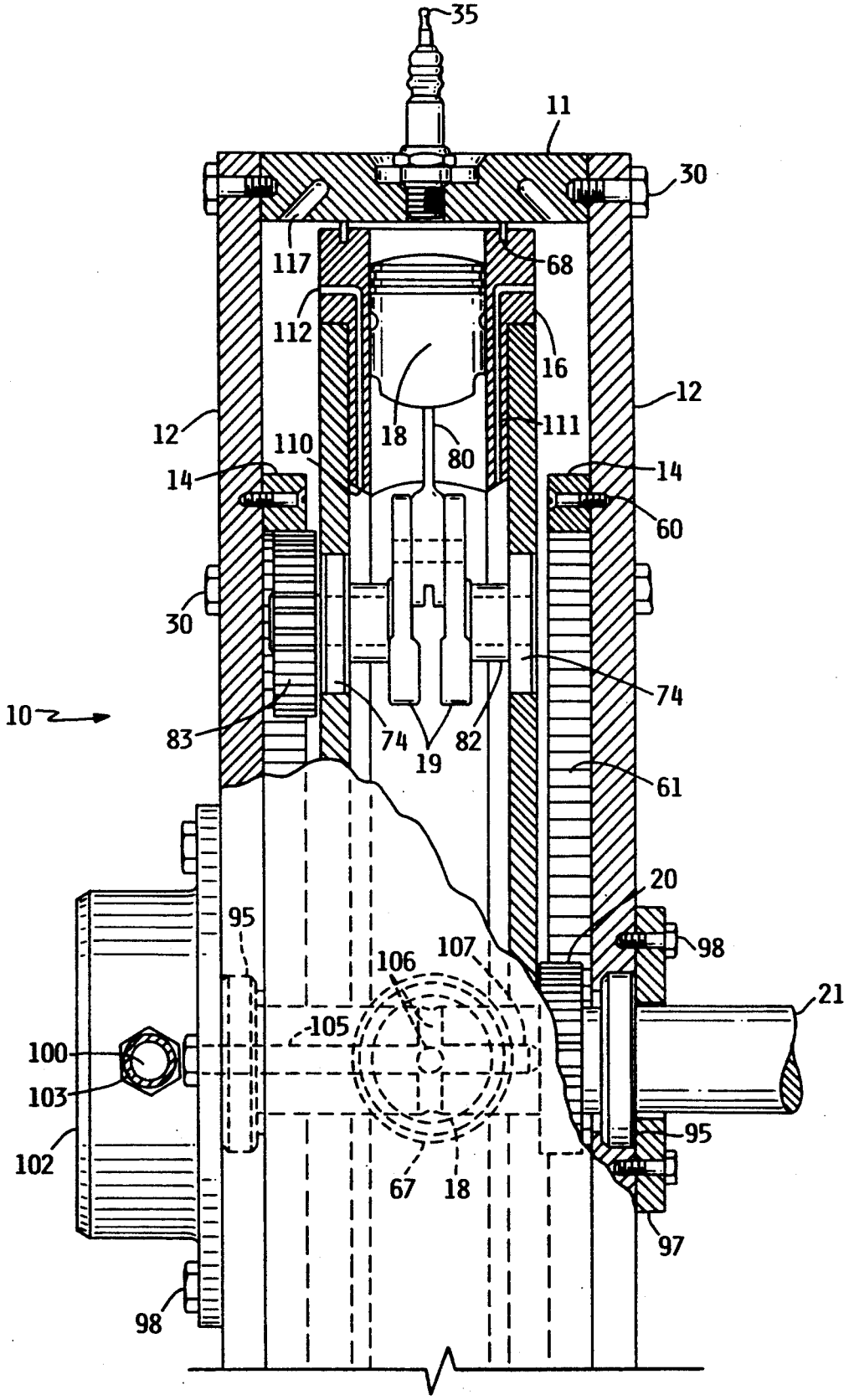
FIG. 4 is an elevation, partially section and phantom view of the rotary engine at lines 4—4 of FIG. 3.

A pair of fuel intake ports 40 are formed in the head 11 diametrically opposite of each other. The middle of each of the intake ports 40 is disposed at approximately a 67°–68° arc from its respective spark plug 35. Each of the intake ports 45 is oblong in shape and runs for about 40° from about 87°–88° to about 47°–48° prior to its respective spark plug 35. In other words, if the spark plug 35 shown in section in FIG. 3 is at 0°, then one intake port 40 is open from about 92°–93° to about 132°–133° and the second intake port 40 is open from about 272°–273° to about 312°–313°. Each of the oblong intake ports 40 includes a leading curved edge 41 and a trailing curved edge 42. An intake port manifold 43 is mounted on the exterior surface 32 of the head 11 over each of the intake ports 40 via pin connectors 44 and includes an intake feed pipe 45. Fuel is supplied to the cylinder 17 through the intake ports 40. Each of the pistons 18 is immediately past a fully extended position when its respective cylinder 17 tracks across the leading edge 41 and is almost fully retracted hen its respective cylinder 17 tracks across the trailing edge 42 of each of the intake ports 40. The pistons 18 then reciprocate outwardly between the trailing edge 42 of each of the intake ports 40 and the respective spark plugs 35 to compress fuel as the rotor 16 revolves to bring the cylinder 17 into alignment with the respective spark plugs 35 whereupon the spark plugs 35 fire to drive the cranks 19 and crank gears 20. The spark plugs 35 may fire when the cylinder 17 is a few degrees away from moving into alignment to provide a greater thrust to the expansion stroke.

A pair of exhaust ports 50 are formed in the head 11 diametrically opposite of each other. The middle of each of the exhaust ports 50 is disposed at approximately a 67°–68° arc from its respective spark plug 35.

Each of the exhaust ports 50 is oblong in shape and includes a leading edge 51 and a trailing edge 52.

If the spark plug 35 shown in section in FIG. 3 is at 0°, then the leading edge 51 of one exhaust port 50 is disposed at about 47°-48° and the trailing edge 52 is disposed at about 87°-88°. The leading edge 52 of the other exhaust port 50 is disposed at about 227°-228° and its respective trailing edge is disposed at 267°-268°. An exhaust manifold 53 is mounted on the exterior surface of the head 11 over each of the exhaust ports 50 via pin connectors 54. Combustion gasses are exhausted through the ports 50 and the pistons 18 reciprocate outwardly when the cylinders 17 track across the ports 50. The pistons 18 are just past being fully retracted when the cylinders 17 track across the leading edge 52 and are almost fully extended when the cylinders 17 track across the trailing edge 53.

The pair of ring gears 14 are affixed to the inside faces of the frame plates 12 such that each of the gears 14 is disposed in one end and axially aligned with the head 11. The ring gears 14 are affixed to the frame plates 12 via pin connectors 60. Each of the inner edges of each of the ring gears 15 includes a plurality of teeth 61 for meshing with one of the crank gears 20.

The rotor 16 includes an outer cylindrical surface 65, an inner cylindrical surface 66, and the set of four cylinders 17 which extend radially between the surfaces 65, 66. The four cylinders 17 are spaced at 90° arcs such that each of the cylinders 17 is diametrically opposite one of the other cylinders 17. Each of the cylinders 17 includes a circular compression groove 67 formed in the outer surface 65 of the rotor 16 about its respective cylinder 17 for seating a compression ring 68. Each of the circular compression grooves 67 has a diameter larger than the width of each of the ports 40, 50. It should be noted that a pair of grooves 67 may be disposed about each of the cylinders 17 for mounting a pair of compression rings 68. Such an arrangement may provide a better seal between the rotor 16 and head 11. The rotor 16 has an outside diameter approximately equal to or slightly less than the inside diameter of the head 11 to turn in a rotary motion in the head 11.

The rotor 16 further includes peripheral flanges 70 between which are mounted disc-like crank support plates 71. Each of the crank support plates 71 is fixed to each end of the rotor 16 between the flanges 70 with pin connectors 72 and includes a set of four apertures 73 for mounting a set of four crank bearings 74. Each of the crank support plates 71 further includes a central hole 75 in which the power take off shaft 21 is rigidly fixed.

The pistons 18 reciprocate in the cylinders 17 and include connecting rods 80. Each of the connecting rods 80 is pivotally joined to one pair of cranks 19. Each of the cranks 19 includes a crank rod 81 riding in one of the crank bearings 74 and extending through one of the crank support plates 71. Each of the crank gears 20 is fixed on the distal end of one of the crank rods 81. Bushings 82 on the crank rods 81 are disposed between each of the cranks 19 and its respective crank bearing 74. Each of the crank gears 20 includes a set of teeth 83 for meshing with the teeth 61 of the ring gears 14. The gear ratio of the ring gears 14 to the crank gears 20 is 4-1. The ring gears 14 have four times as many teeth 61 as the crank gears 20 have teeth 83.

Each of the distal ends of the crank rods 81 includes a crank key 90 for cooperating and being aligned with a recess in its respective crank gear 20. The power take off shaft 21 includes a pair of power take off locking keys 91 for cooperating and being aligned with recesses formed in the crank support plates 71.

A pair of main power take off bearings 95 are held in apertures 96 formed in frame plates 12 by main bearing cover plates 97. The cover plates 97 are fixed to the frame plate 12 with pin connectors 98.

An oil intake 100 is formed axially in one end 101 the power take off shaft 21. The end 101 is received in an oil feed cup 102 fixed to one of the main bearing cover plates 97. An oil feed line 103 is connected to and conveys oil to the oil feed cup 102.

Oil is conveyed under pressure from the oil intake 100 into an oil feed line 105 extending axially in the power take off shaft 21. A set of four oil outlets 106 extend radially from the oil feed line 105 to direct oil to the inside of the rotor 16. Each of the oil outlets 106 may be radially aligned with one of the four cylinders 17. The outlets 106 are formed near but spaced from an end 107 of the oil feed line 105.

From the inside of the rotor 16, oil is conveyed into oil inlets 110 formed in the inner surface 66 of the rotor 16. Rotor oil lines 111 extend radially from the oil inlets 110 to oil outlets 112 leading through the peripheral lips 70 of the rotor 16. Each of the rotor oil feed lines 111 extends adjacent each of its respective cylinder for more than one-half the length of its respective cylinder. Centrifugal force created by the spinning rotor 16 conveys oil into the inlet 110, through line 111 and out of the outlets 112 to the crank gears 20 riding in the ring gears 14. Oil then drains by gravity to oil outlets 115 formed in each of the frame plates 12. Oil outlet lines 116 are connected to the oil outlets 115. Oil may be delivered to the head 11 via oil inlets 117 formed in the head 11 about the spark plug seats 36.

In operation, rotation of the rotor 16 and power take off shaft 21 is initiated by a starter such as used on a conventional internal combustion engine. As the rotor 16 begins to revolve in the cylindrical head 11, two of the cylinders 17 which are diametrically opposed begin to move into alignment with the fuel intake ports 40. As the compression rings 68 of the cylinder 17 engage the inner cylindrical surface 33 of the head 11 about the leading edge 41 of the intake ports 40, fuel typically under pressure enters the cylinders 17. The pistons 18 are 2°-3° past their fully extended positions at such a point. As the cylinders 17 track across the intake ports 40 from the leading edge 41 to the trailing edge 42, the pistons 18 retract to draw in a maximum amount of fuel. As the cylinders 17 track across the trailing edges 42 of the intake supports 40, the pistons 18 are 2°-3° away from being at their fully retracted positions.

The compression stroke of the fuel laden diametrically opposed cylinders 17 begins as the compression rings 68 track away from the trailing edges 42 to fully engage the inner cylindrical surface 33 of the head 11. The compression rings 68 engage the inner surface 33 until the cylinders 17 move into alignment with the spark plugs 35. The spark plugs 35 fire when the cylinders 17 are 2°-3° away from being aligned with the spark plugs 35 to thereby begin an expansion stroke.

The expansion stroke is initiated when the spark plugs 35 fire to linearly to drive the pistons 18. The pistons 18 drive the connecting rods 80 which in turn drive the cranks 19 in a rotary motion. As the cranks 19 are driven, the crank rods 81 rotate in the crank bearings 74 and the crank gears 20 rotate and mesh with the gears 14 at a ring gear to crank gear ratio of 4 to 1.

As the crank gears 20 mesh with and ride in the ring gears 15, the crank rods 80 bring pressure to bear on the crank bearings 74. Such pressure on the crank bearings 74 and crank support plates 71 drives the rotor 16 in a rotary motion in the head 11. The rotor 16 in turn drives the power take off shaft 21.

Following the compression stroke, the exhaust stroke begins as the compression rings 68 of the cylinders 17 track across the leading edges 51 of the oblong exhaust ports 50. The pistons 18 are 2°-3° past their fully retracted positions at this point. As the pistons 18 are linearly extended in their respective cylinders 17, combustion gasses are forced into the exhaust manifold 53. The exhaust stroke ends when the compression rings 68 of the cylinder 17 track across the trailing edge 52 of the exhaust port 50. At this point, the pistons 18 are 2°-3° away from being fully extended.

As two diametrically opposed cylinders complete their exhaust strokes, they immediately begin new intake strokes. Simultaneously, the other two diametrically opposed pistons 17 are completing their compression strokes and are beginning their expansion strokes. The inertia of the rotor 16 drives the rotor 16 when two diametrically opposed pistons 17 are being extended during their exhaust strokes, and the other two diametrically opposed pistons are being retracted during their intake strokes.

It should be noted that the rotor 16 may include eight cylinders 18 and eight pistons 17. The cylinders 18 in such an embodiment are spaced at 45° from each other, at 0°, 45°, 90°, 135°, 180°, 225°, 270° and 315°, as shown in FIG. 3. With this arrangement, a driving force is continuously applied to the power take off shaft because at least two pistons 17 are always being propelled through their expansion strokes.

It should further be noted that each of the pair of cranks 19 may drive only one crank gear 20. In such an embodiment two diametrically opposed pistons 18 drive crank gears 20 in one of the ring gears 14; the other two diametrically opposed pistons 18 drive crank gears 20 in one of the ring gears 14; the other two diametrically opposed pistons 18 drive crank gears 20 in the other ring gear 14. This embodiment reduces wear and friction, while maintaining symmetry and balance.

One of the chief advantages of the present rotor reciprocating engine is the free breathing ability of the cylinders 17 and pistons 18 as cylinders 17 track across the intake and exhaust ports 40, 50.

Another advantage is the simplicity of manufacture of its moving parts. Most of the moving parts are machined in a circular fashion to increase engine life.

Another advantage is the stabilizing effect of the gyroscopic action of the rotation of the rotor 16 on the vehicle being powered. Such a stabilizing effect is provided when the rotor 16 is disposed so as to revolve in a horizontal plane.

Another advantage is that the present rotary reciprocating engine concept may be expanded to accommodate any number of rotors 16. Such an engine would be inherently well balanced due to the opposed action of the multiple cranks within each of the stacked rotors 16. The number of pistons 17 may also be increased by enlarging the diameter of the rotor 16 and head 11.

Another advantage is the elimination of noise. When valves of a standard valved engine and other moving parts of a conventional engine associated with these valves are eliminated, a great deal of the noise of such a motor is also eliminated.

Another advantage is that a great deal of weight of a standard valved engine is eliminated. The present rotary reciprocating engine thus has a greater power to weight ratio than a conventional engine.

Another advantage is that the present rotary reciprocating engine has greater flexibility in applications requiring different power needs. By changing the gear ratio of the internal gearing system, the number of piston strokes per power take off shaft revolution is variable.

Another advantage is the elimination of the need for a counter balance shaft in the rotor 16. The present rotary reciprocating engine uses individual crankshafts to effect a perfect counteracting piston action within the same plane inside the head 11. This allows a great number of pistons 17 to utilize the same intake and exhaust ports, as well as the same firing mechanism. The inherent balance in such a design precludes the need for a counter balance shaft.

Another advantage is that the oiling system of such a rotary reciprocating engine is less contaminated. Since the centrifugal action of the rotor tends to force exhaust gasses outwardly through the exhaust port, instead of the crank case, oil used for lubrication and cooling is less contaminated.

Another advantage is the simplicity of all the machined parts. Most of the parts are machined in a circular motion, with no intricate machining problems, such as for cam shafts or lobes.

Another advantage is that the present engine may require up to one-third less moving part per engine than a modern quad-four engine. Such an elimination of parts contributes to a great reduction of noise, and wear of parts.

Another advantage is that the present engine burns more efficiently and cleaner than a conventional engine. Hence it may not require a catalytic afterburner.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A rotary reciprocating internal combustion engine comprising:

a housing which comprises a cylindrical head with two ends and frame plates mounted on both ends of the head to enclose the head, the head including a pair of fuel intake ports and a pair of exhaust ports, the intake ports being diametrically opposite each other and the exhaust ports being diametrically opposite each other, each of the ports being oblong in shape and extending for an arc of at least 25°, the head and each of the frame plates including an inner and outer surface, the head further including an ignition mechanism which comprises a pair of spark plugs diametrically opposite of each other, a pair of ring gears, each of the ring gears fixed on the inner surface of one of the frame plates and axially aligned with the cylindrical head, each of the ring gears disposed in one end of the head, a rotor axially aligned in the cylindrical head and comprising a set of four radially extending cylinders and pistons reciprocable in the cylinders such that each of the pistons twice executes an intake, compression, combustion and exhaust cycle for each revolution of the rotor, each of the four pistons driving a connecting rod which in turn rotates a crank, each of the cranks having two ends, each of the cylinders being arcuately spaced at 90° arcs from two of the other cylinders, the rotor further including two ends defined by integral peripheral flanges and a disk-shaped crank support plate fixed to and set in each of the ends to engage each of the peripheral flanges, each of the crank support plates including a set of four crank bearings, each of the crank ends extending through one of the crank plates and riding in one of the bearings, a power take off shaft fixed to the crank support plates and axially aligned with the rotor, the shaft having a pair of ends and a shaft portion disposed in the rotor between the crank support plates, oiling means for oiling the rotary engine, the oiling means comprising a shaft oil line in the power take off shaft, rotor oil lines, and a housing oil line, the shaft oil line including an inlet formed in one end of the shaft, a set of four radially extending outlets formed in the shaft portion between the crank support plates, and an axially extending oil feed line axially formed in the shaft and extending from the inlet in the shaft to outlets in the shaft to direct oil to the cylinders and pistons, each of the radially extending outlets being radially aligned with one of the cylinders and radially extending from a common point, each of the rotor oil lines including an inlet formed in an inner edge of the rotor, an outlet formed in one of the peripheral flanges of the rotor, and a rotor oil feed line extending radially from its respective inlet in the rotor to its respective outlet in the rotor to direct oil from the cylinders and pistons to the ring gears, each of the rotor oil feed lines extending adjacent each of the cylinders for more than one-half the length of its respective cylinder, the housing oil line including an inlet formed in the inner surface of the head and an outlet formed on one of the frame plates to direct oil from the ring gears to the exterior of the housing, and a set of eight crank gears, each of the crank gears fixed on one of the ends of the crank and meshing with one of the ring gears, each of the crank gears being driven by one of the pistons through its respective crank and in turn driving the rotor in a rotary motion in the cylindrical head to drive the power take off shaft.

* * * * *